United States Patent [19]

Osheroff

[11] 4,211,363

[45] Jul. 8, 1980

[54] FLUIDICALLY-CONTROLLED AIR-CONDITIONING SYSTEM

[75] Inventor: Gene W. Osheroff, Las Vegas, Nev.

[73] Assignee: McQuay-Perflex, Inc., Minneapolis, Minn.

[21] Appl. No.: 657,200

[22] Filed: Feb. 11, 1976

[51] Int. Cl.[2] ..... F24F 3/06

[52] U.S. Cl. ..... 236/49; 137/805; 236/80 D

[58] Field of Search ..... 236/38, 49, 80 D, 79; 137/804, 805

[56] References Cited

U.S. PATENT DOCUMENTS

| | | | |
|---|---|---|---|
| 3,176,920 | 4/1965 | Severson | 236/79 |
| 3,680,776 | 8/1972 | Osheroff | 236/49 |
| 3,837,571 | 9/1974 | Waeldner et al. | 236/80 D X |
| 3,840,177 | 10/1974 | Osheroff | 236/80 D X |
| 3,937,398 | 2/1976 | Waeldner et al. | 236/80 D X |

*Primary Examiner*—William E. Wayner
*Assistant Examiner*—William E. Tapolcai, Jr.
*Attorney, Agent, or Firm*—Allen E. Botney

[57] ABSTRACT

The present invention is one that uses the novel feature of fluidics to control the flow of conditioned air in an air-conditioning system. More specifically, in one species of the invention, fluidic amplifier apparatus controls the flow of hot water into the coils and, therefore, controls the changeover from cool to warm air in the main duct, and in a second species it not only controls the mentioned changeover but also the volume of the conditioned air flowing in the duct.

9 Claims, 5 Drawing Figures

FLUIDICALLY-CONTROLLED AIR-CONDITIONING SYSTEM

The present invention relates to air-conditioning systems in general, and more particularly relates to an air-conditioning system in which fluidic principles are employed to provide temperature control as well as volume control.

In the customary type of air-conditioning system, the flow of conditioned air is subject to "On-Off" control, by which is meant that the conditioned air will continue to flow into a room or zone until the air therein substantially attains the temperature at which the thermostat has been set, at which time the flow of air is turned "Off" and it will remain "Off" until the room temperature has sufficiently drifted from the set temperature, at which time it is turned "On" again. However, in a number of instances, the requirements are such that the conditioned air must flow continuously, at least at half volume, and in such instances the cool air flowing into the room or zone must be heated at some point in time or else the room or zone will be overcooled. This heating is customarily achieved by mounting hot-water coils in the duct leading to the room or zone and, at the appropriate time, hot water is caused to pass through these coils. The cool air is then warmed as it passes over these coils.

The latter type of system mentioned hereinabove, namely, that involving continuous air flow, exists in the prior art, but it almost always involves and includes a host of mechanical linkages, gears, dampers, motor drives, pneumatic or electric power sources, etc. In short, these prior-art systems use relatively complex electro-mechanical subsystems that inevitably means greater initial capital investment, increased maintenance and replacement costs, the provision of separate energy sources and the costs attendant therewith, etc. The present invention, on the other hand, uses fluidic technology to accomplish the required temperature and volume control and thereby substantially eliminates many of the disadvantages encountered in the prior art, some of which have been mentioned hereinabove. More particularly, through the use of fluidic apparatus, the present invention pretty much eliminates the electro-mechanical subsystems used in the prior art and, furthermore, it provides what may be termed a self-contained system in that the fluidic apparatus, for its operation, utilizes the energy of the air already flowing in the ducts, with the result that additional energy sources are no longer needed.

It is, therefore, an object of the present invention to employ fluidic technology to achieve temperature and volume control in an air-conditioning system.

It is a further object of the present invention to improve the effectiveness of an air-conditioning system by applying fluidic principals to the system's temperature and volume control apparatus.

It is an additional object of the present invention to reduce the energy requirements of an air-conditioning system through the use of fluidic rather than electro-mechanical subsystems.

The novel features which are believed to be characteristic of the invention, both as to its organization and method of operation, together with further objects and advantages thereof, will be better understood from the following description considered in connection with the accompanying drawings in which embodiments of the invention are illustrated by way of example. It is to be expressly understood, however, that the drawings are for the purpose of illustration and description only and are not intended as a definition of the limits of the invention.

FIG. 1(*a*) is a cross-sectional view of a valve controlling the flow of hot water to the hot-water coils in the duct and illustrates its basic construction;

Figure 1:
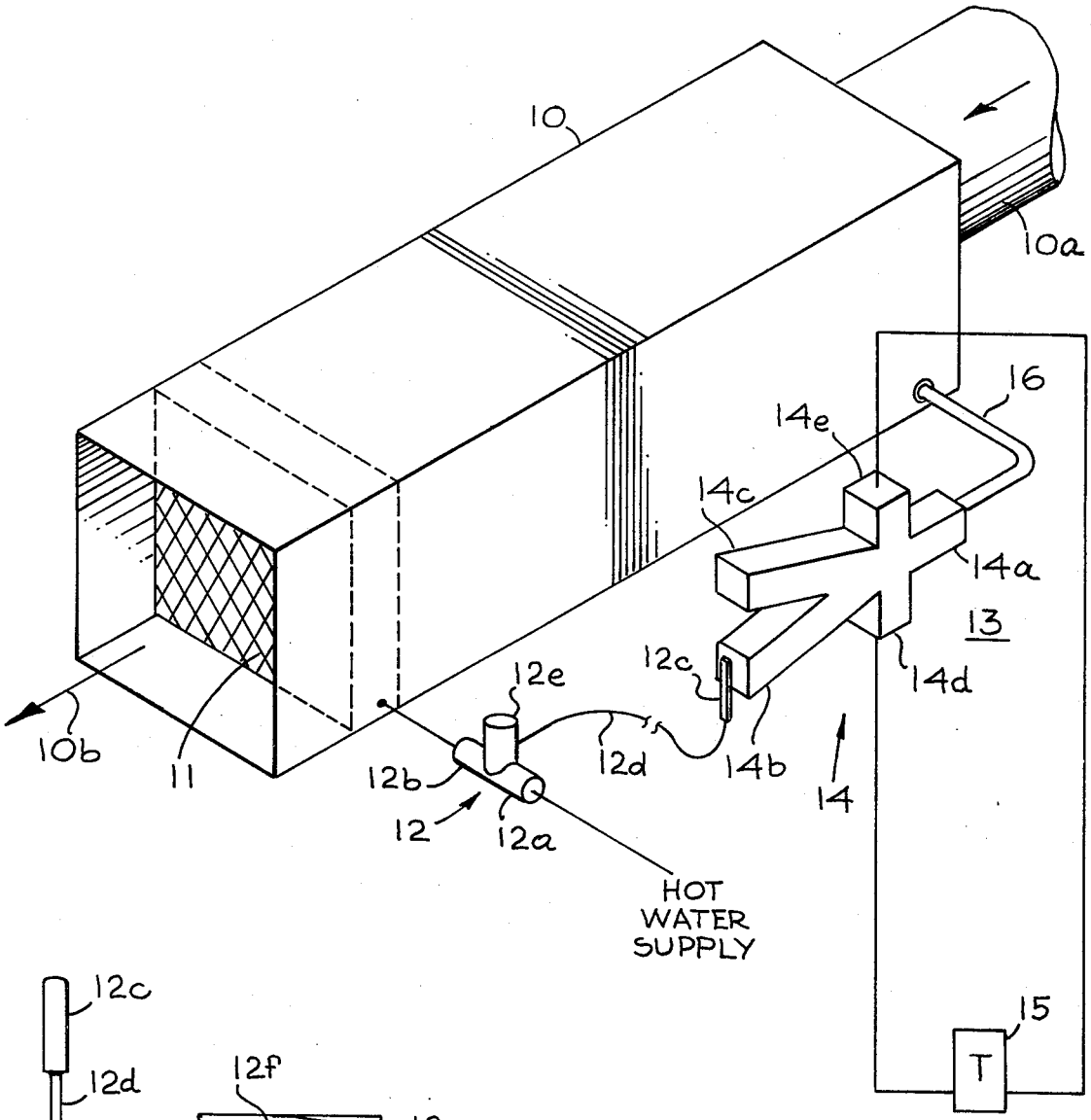
FIG. 1 shows a portion of a duct feeding conditioned air into a room or zone and illustrates how, in a first species of the invention, fluidic apparatus was used to control the temperature of the air therein.
Figure 1A:
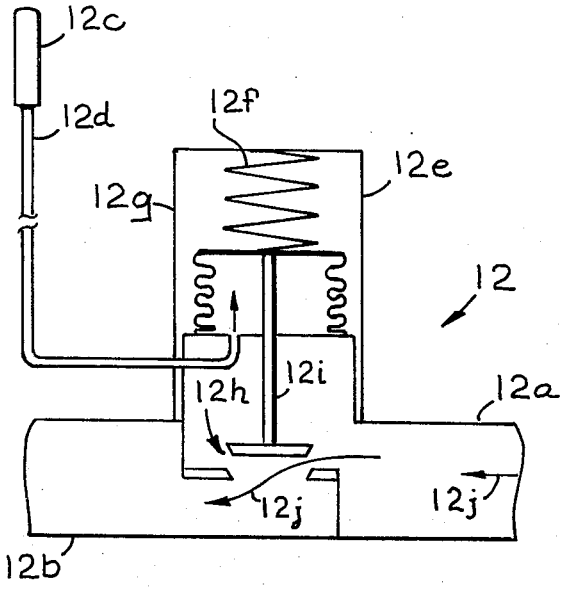

For a more complete understanding of the details of the invention, reference is now made to the drawings wherein, in FIG. 1, an embodiment of the invention is shown to basically include a duct 10 to which conditioned air is fed at one end via input 10*a* and from which it exists at the other end, as indicated by arrow 10*b*. A hot-water coil 11 is mounted at some point in the duct, preferrably close to its output end, the coil being coupled through a Dan Foss type of valve 12, or some other suitable valve, to a hot-water supply (not shown). Completing the FIG. 1 embodiment is a fluidic control arrangement, generally designated 13, that comprises fluidic amplifier apparatus 14 and a thermovalve 15. The diagram of fluidic apparatus 14 is in schematic form and, therefore, represents anyone of a number of fluidic devices that may be used, but irrespective of the kind of fluidic device used it will include, as is shown by the schematic, an input channel 14*a*, a pair of output channels 14*b* and 14*c*, and a pair of control channels 14*d* and 14*e*. Input channel 14*a* is linked or coupled to duct 10 by means of a hose or pipe 16, as is shown in the figure, and, therefore, a small portion of the air entering the duct is tapped off by hose 16 and fed to input channel 14*a*. As for output channels 14*b* and 14*c*, both are open-ended. An example of a fluidic device that can be utilized as the fluidic apparatus in the FIG. 1 embodiment is the fluidic oscillator, and the various species thereof, shown and described in U.S. Pat. No. 3,680,776 entitled "Fluidic Apparatus For Air-Conditioning Systems," by Gene W. Osheroff, issued Aug. 1, 1972. The portions of said patent illustrating and describing said oscillators and their operation are incorporated herein by said reference as though said portions were fully set forth. Suffice it to say at this point, therefore, that a steady stream of conditioned air enters these fluidic oscillators, that is to say, the air entering the oscillator is steady state, but the oscillator converts this steady stream of air to pulses of air that are alternately applied by the oscillator to its two output channels, the duration of the pulses through these channels being generally different from one another and also varying with the passage of time. More specifically, the duration of the pulses through one or the other of these output channels and, therefore, through both of them, is under the control of or, stated differently, regulated by thermovalve 15 which, in turn, means that their duration is a function of the temperature conditions of the room to be conditioned.

As for thermovalve 15, here again, anyone of a number of different available thermovalves may be used, but one that has already been used and found to be suitable for such use is that shown and described in U.S. Pat. No. 3,730,430 entitled "A Thermovalve," by Gene W. Osheroff, issued May 1, 1973. The pertinent illustrative and descriptive portions of said patent are incorporated herein by this reference as though said portions were fully set forth. It will be recognized that thermovalve 15 is located in the space to be conditioned and, as is shown in FIG. 1, is coupled to control channels 14*d* and 14*e*.

The Dan Foss valve 12, shown more fully in FIG. 1(*a*), includes an input port or tube 12*a* through which the hot water enters the valve, an output port or tube 12*b* through which the hot water flows to hot-water coils 11, and a bulb 12*c* coupled to the main body of the valve by means of a tube 12*d*. The basic structural mechanism of the valve is contained within the chamber formed by the jacket or housing structure 12*e* and includes a spring 12*f* mounted between the roof of said chamber and the roof of a bellows device 12*g*, the roof of the bellows being free to move up and down in the chamber as the bellows expands and contracts. The floor of the bellows, on the other hand, is fixedly mounted in the position illustrated in FIG. 1(*a*). As shown in FIG. 1, bulb 12*c* is positioned in close proximity to the output of output panel 14*b* and, as shown in FIG. 1(*a*), one end of tube 12*d* is coupled to bulb 12*c* and the other end to bellows 12*g*, both couplings being designed to be leak proof. The valve element itself, that is to say, the member that opens and closes to respectively admit and prohibit the hot water, is generally designated 12*h*, and is under the control of a shaft 12*i* that slidably extends through the bottom wall or floor of bellows 12*g* to its upper wall or roof to which the shaft is fixedly attached. Thus, shaft 12*i* acts like a piston in that, as the bellows expands and contracts, it respectively moves up and down to open and close valve element 12*h*. Finally, valve 12 includes a volatile type of fluid, such as Freon, that partially fills the space in bulb 12*c*, tube 12*d* and bellows 12*g*, the bellows expanding and contracting, respectively, as the fluid changes to a gas and vice versa. When valve element 12*h* is open, the hot water flows through the valve and thereafter to hot-water coils 11 in the direction of arrows 12*j*.

Considering now the operation of this FIG. 1 embodiment, it will initially be assumed that the thermostat in thermovalve 15 has just been set to the desired room or zone temperature and that a significant difference exists between this temperature and the actual or ambient temperature of the room or zone. Merely by way of example, the air temperature may be 80° F. and the thermostat may have been set to bring the air temperature down to 70° F. It will also be initially assumed that fluidic apparatus 14 is of the oscillator type previously identified. Accordingly, under the assumed conditions, all the cool conditioned air, customarily at 55° F., tapped or siphoned off from duct 10 by hose 16 and passing through fluid oscillator 14 will initially emerge from output channel 14*b* and impinge upon bulb 12*c*. The cool air against the bulb causes the Freon or other material in valve 12 that is in gaseous form to condense, thereby reducing the pressure in bellows 12*g*. This, in turn, causes the bellows to deflate as spring 12*f* pushes against it, with the result that shaft 12*i* moves to close valve element 12*h* or, if the valve element is already closed, to keep it closed. With the Dan Foss valve 12 closed, no hot water can flow to coil 11, with the result that unwarmed conditioned air, that is to say, air at 55° F. flows out of duct 10 and into the room or zone.

With conditioned air flowing into the room or zone, the temperature of the air therein gradually approaches the temperature setting of the thermostat and as the difference between these two temperatures decreases, the amount of conditioned air impinging upon bulb 12*c* correspondingly decreases. This is brought about by the fact that as this temperature differential diminishes, at a point determined by the characteristics of thermovalve 15 fluidic apparatus 14 begins to oscillate and, at this point, the air emerging from output channels 14*b* and 14*c* is pulsed, the pulses alternating between the output channels to respectively produce two trains of pulses of conditioned air. The duration of the pulses in one train will generally vary with the passage of time and will generally differ from the duration of the pulses in the other train, but since the total amount of air exiting from apparatus 14 must be equal to the amount of air entering it, the duration of the pulses in one output channel will become smaller as the duration of the pulses in the other train becomes larger, and vice versa.

A previously mentioned, the relative duration of these pulses is a function of the temperature conditions in the room or zone. Thus, as the gap between the temperature of the ambient air and the temperature at which the thermostat is set narrows, the duration of the pulses of conditioned air coming out of output channel 14*b* and impinging against bulb 12*c* grows correspondingly smaller and the duration of the pulses emerging from output channel 14*c* grows correspondingly larger. As a result, the net or average amount of cool air directed against the bulb decreases and the amount of time the bulb is exposed to the ambient air increases as the temperature of the ambient air approaches the thermostatic setting, with the further result that, the Freon in the Dan Foss valve (or other fluid if one other than Freon is used) increasingly gassifies. These increasing amounts of gas enter bellows 12*g* and increase the pressure there, the result being that at some point in the conditioning process the bellows begins to expand or inflate against the action of the spring, and when this occurs valve element 12*h* partially opens to permit some hot water to flow therethrough to hot water coil 11. Hence, when the valve starts to open, hot water starts to flow and the conditioned air in duct 10 starts to get warmed. A partially opened valve is illustrated in FIG. 1(*a*) with arrows 12*j* representing the direction of hot water flow. This process will continue until the temperature of the room air is substantially the same as the temperature setting of the thermostat, at which point the conditioned air passing over hot-water coils 11 will be heated or warmed to an extent sufficient to maintain the air in the room or zone at the desired temperature. Of course, from a purely technical point of view, it will be recognized by those skilled in the art that there will be some fluctuations, that is to say, the system will constantly hunt, as room conditions vary, in order to return the room or zone temperature to the thermostat set point.

Figure 2:
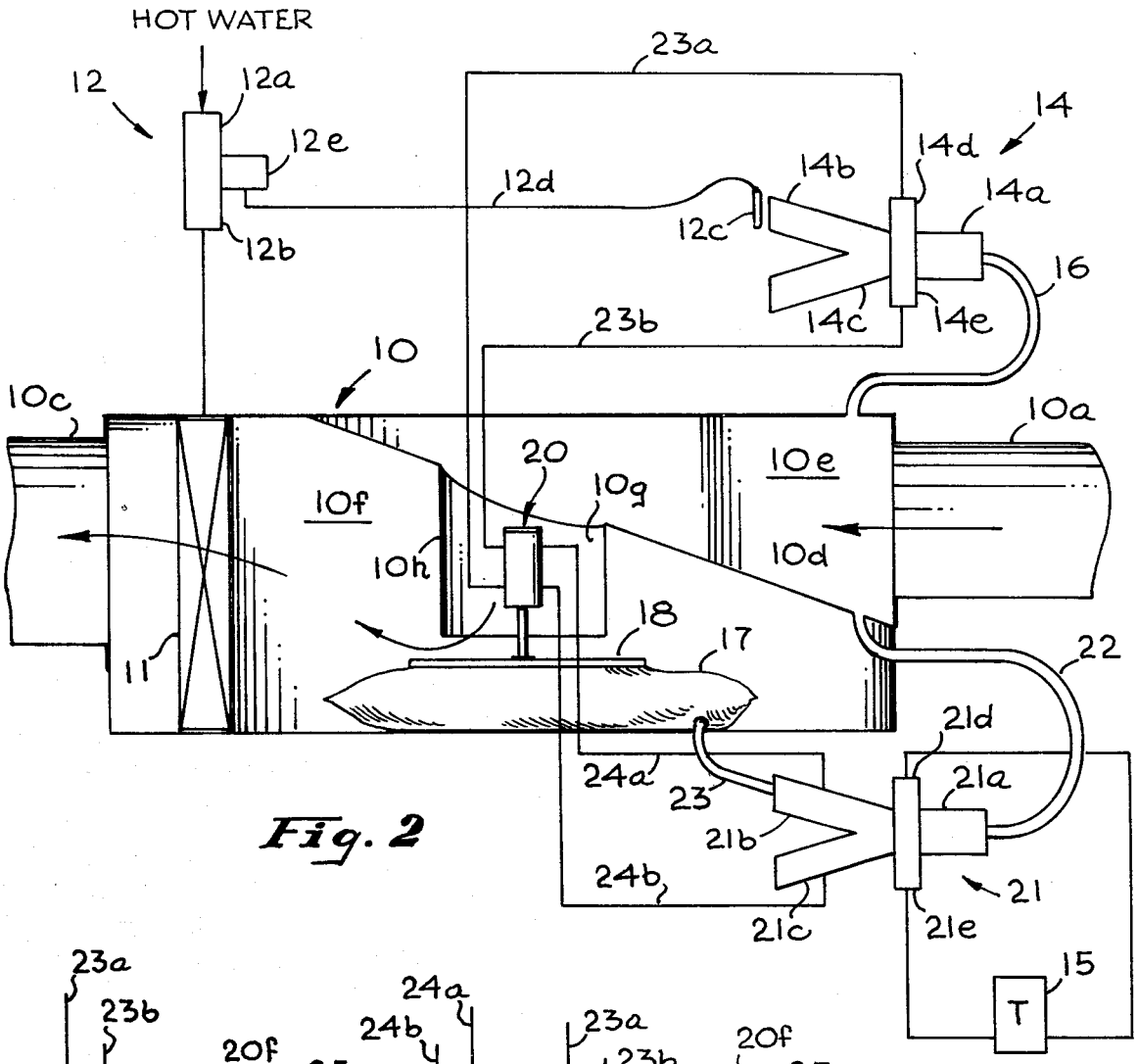
FIG. 2 is a second species of the present invention which shows how fluidic apparatus can be used to control the volume as well as the temperature of the air emerging from the system.
Figure 3A:
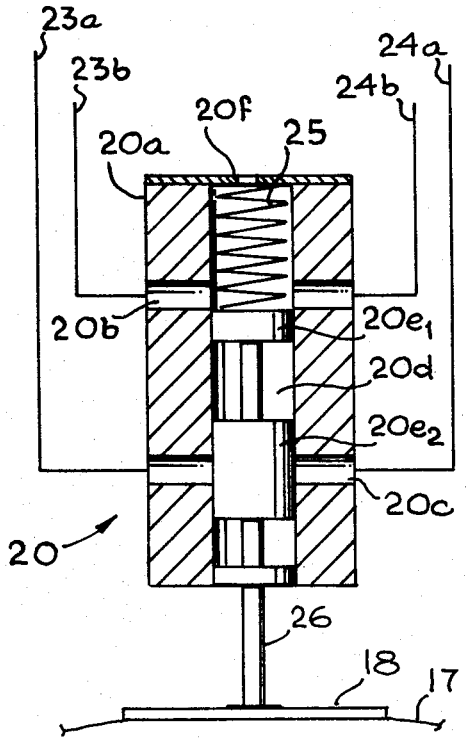
FIGS. 3(*a*) and 3(*b*) are cross-sectional views of the spool valve used in the FIG. 2 species and illustrates two positions of the valve elements.
Figure 3B:
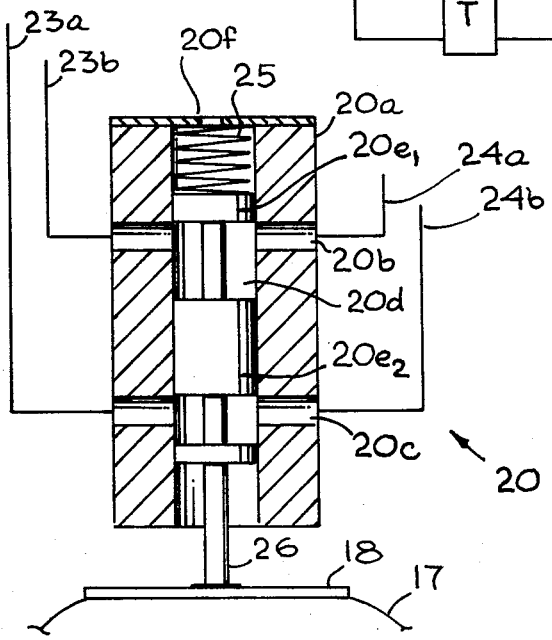

The FIG. 1 embodiment described hereinabove is one in which fluidics is applied to temperature regulation or control. However, the FIG. 1 embodiment can be modified by the further addition of fluidic apparatus to provide volume control as well, as shown in FIGS. 2 and 3 to which reference is now made. More particularly, in the FIG. 2 embodiment, duct 10 is shown to include a diagonally oriented partition 10*d* that may be said to divide the duct structure into two plenums or chambers 10*e* and 10*f*. As may be deduced from an examination of FIG. 1, an area of partition 10*d* is cut away to form an opening 10*g* therethrough and a small section of duct, hereinafter referred to as nozzle 10*h*, is mounted on the partition beneath said opening and extends downwardly therefrom into chamber 10*f*. Accordingly, opening 10*g* and nozzle 10*h* provide a path into chamber 10*f* for the conditioned air entering chamber 10*e* via input duct 10*a*, and from chamber 10*f* out through an output duct 10*c* to the room or zone to be conditioned. As before, hot-water coils 11 are mounted toward the output end of duct 10 and, therefore, in chamber 10*f* preceding the entrance to output duct 10*c*.

Mounted in chamber 10*f* directly beneath nozzle 10*h* is a long-life bellows 17 on and to the upper wall of which is mounted a plate 18. One purpose of plate 18 is to provide a flat, solid surface to insure that as the bellows expands, the mouth of the nozzle will close evenly and firmly. A further and important purpose of plate 18 is to provide a flat, solid surface for the operation of the spool valve, generally designated 20, that is mounted in a fixed position within nozzle 10*h*. Needless to say, plate 18 may be made of any material suitable for said purpose, preferably a relatively light material so as not to unnecessarily load the bellows.

As previously mentioned, this embodiment includes a second arrangement of fluidic amplifier apparatus, generally designated 21, apparatus 21 preferably being the same as fluidic amplifier apparatus 14. Accordingly, as in the case of fluidic amplifier apparatus 14, fluidic amplifier apparatus 21 is of the oscillator type previously identified and having the same operative features. It includes an input channel 21*a* coupled to chamber 10*e* by means of a hose 22, a pair of output channels 21*b* and 21*c*, output channel 21*b* being coupled to bellows 17 through a hose 23, and a pair of control channels 21*d* and 21*e* coupled to thermovalve 15. Thermovalve 15 is the same as that previously identified herein, but in this embodiment it is connected to the control channels of apparatus 21 rather than to those of apparatus 14. Instead, control channels 14*d* and 14*e* are respectively coupled through spool valve 20 to openings or orifices in output channels 21*c* and 21*b*, the exact manner in which the coupling through the spool valve is effected will be described below. In order to facilitate an explanation of the operation of the embodiment and to expedite its understanding, it is deemed worthwhile to designate the tubes or hosing by means of which control channels 14*d* and 14*e* are coupled to the other parts in the system. Accordingly, the tubes that couple control channels 14*d* and 14*e* to spool valve 20 are respectively designated 23*a* and 23*b*, whereas the tubes that couple output channel 21*b* and 21*c* to the spool valve are respectively designated 24*a* and 24*b*.

The spool valve is shown in detail in FIGS. 3(*a*) and 3(*b*) and, as shown therein, it includes a solid housing structure 20*a* through which a pair of channels 20*b* and 20*c* transversely extend, tubes 23*a* and 23*b* respectively connecting to one end of channels 20*c* and 20*b*, and tubes 24*a* and 24*b* respectively connecting to the other end of channels 20*b* and 20*c*. The spool valve includes still a third channel or cylinder 20*d* in which a piston extending in a longitudinal direction, that is to say, crosswise to channels 20*b* and 20*c*. Piston 20*e* is slidably mounted in cyclinder 20*d* between a spring 25 and a shaft element 26, the spring being attached to both the roof of housing 20*a* and the top of piston 20*e*. An opening or orifice 20*f* through the roof of housing 20*a* is located in cylinder 20*d* above spring 25 and is provided to vent cylinder 20*d* and, therefore, possibly channel 20*b*, to atmosphere. As for shaft element 26, it extends from the bottom of piston 20*e* toward bellows 17 and, depending on design, it may either be linked to plate 18 for positioned in proximity thereto. As may be surmised from FIGS. 3(*a*) and 3(*b*), as a result of the expansion and contraction of bellows 17, as will hereinafter be described, piston 20*e* will respectively move upwardly against the action of spring 25 and downwardly in response to it. Finally, it should be mentioned that piston 20*e* has two heads respectively designated $20e_1$ and $20e_2$, head $20e_1$ being associated with channel 20*b* and head $20e_2$ being associated with channel 20*c*, as will hereinafter be explained.

In considering the operation of the FIG. 2 embodiment, it will again be initially assumed that the thermostat in thermovalve 15 has just been set to the desired room temperature and that a significant differential exists between this temperature and the actual or ambient temperature of the room. Under such conditions, bellows 17 will be almost fully vented or deflated and the space between the bellows and nozzle 10*g* at about a maximum, with the result that the conditioned air supplied to the room will also be at about a maximum. As previously pointed out, the conditioned air flows into chamber 10*e* via duct 10*a*, and from chamber 10*e* it flows through nozzle 10*g* into chamber 10*f* from which it flows via duct 10*c* into the room. Needless to say, the greater the space between bellows 17 and nozzle 10*g*, the less impediment there is to air flow and, therefore, the greater the supply of conditioned air to the room. Of course, the reverse it also true, namely, the smaller the space between the bellows and the nozzle, the greater the impediment and the smaller the supply. Thus, the volume of conditioned air flowing to the room is a function of the space between the nozzle and the bellows which, in turn, is a function of the difference between the ambient room temperature and the temperature setting of the thermostat, at least until the half volume point is reached as will subsequently be seen.

With the conditions assumed, only relatively short pulses of air emerge from output channel 21*b* and flow into bellows 17 whereas rather long pulses of air emerge from output channel 21*c*. In between the short pulses, that is to say, during the time the air is emerging from output channel 21*c*, some portion of the air already in bellows 17 aspirates through output channel 21*c*. Accordingly, under this mode of operation, bellows 17 is almost fully deflated and the space between the bellows and nozzle 10*g* at about a maximum, with the result that the maximum amount of conditioned air flows through the path of duct 10*a*, chamber 10*e*, nozzle 10*g*, chamber 10*f*, and duct 10*c* into the room to be conditioned.

With conditioned air flowing into the room, as described, the temperature of the room gradually decreases and thereby approaches the temperature setting of the thermostat and, as the difference between these two temperatures decreases, the rate of flow of air into the room correspondingly decreases. This is brought about by the fact that as this temperature differential diminishes, the duration of the pulses of air emerging from output channel 21*b* and entering bellows 17 increases whereas the duration of those emerging from output channel 21*c* decreases, as previously mentioned. Accordingly, the overall or net amount of air in the bellows increases as the duration of the pulses of air flowing to the bellows increases, with the result that the bellows inflates as the temperature differential decreases, thereby gradually closing the space between the bellows and the nozzle. Stating it differently, as the cooling requirement decreases, the thermovalve directs the fluidic oscillator to fill the bellows and as the bellows fills and inflates, the nozzle opening is reduced, thereby cutting down on the amount of air delivered to the room.

This process continues until the space between the bellows and nozzle has narro ved to the point where the volume of conditioned air flowing to the room is approximately one-half the full or rated volume. Half volume will approximately have been reached when plate 18 reaches and comes into contact with shaft element 26, at which time spool valve 20 is activated to bring the FIG. 1 type of temperature control into operation.

More particularly, until the spool valve is activated by the bellows, it is in the condition shown in FIG. 3(*a*) in which channel 20*c* is closed by piston head 20*e*$_2$ and channel 20*b* is open and vented or exposed to atmosphere through orifice 20*f*. With the spool valve in this condition, the bias on fluidic amplifier apparatus 14 in such that the cool conditioned air flowing through it emerges from output channel 14*b* and impinges upon bulb 12*c*. As a result and pursuant to the explanation offered earlier, the fluid in Dan Foss valve 12 is cooled and, therefore, in liquid form, with the further result that bellows 12*g* therein is deflated and valve element 12*h* thereby closed. Accordingly, with spool valve 20 in the condition shown in FIG 3(*a*), which is the condition of the valve at least until plate 18 on bellows 17 starts pushing up on shaft element 26, there is no hot water flowing to hot-water coils 11, which means that cool air at the customary 55° F. continues to flow into the room or zone, albeit at approximately half volume.

However, as bellows 17 continues to expand or inflate, piston 20 moves upward in cylinder 20*d* until it ultimately reaches the position shown in FIG. 3(*b*), at which point it stops because it cannot go any further and, when this occurs, the bellows also stops or ceases to expand. It would be well to mention at this time that the spool valve is designed and constructed so that very little further expansion of bellows 17 is required to bring the spool valve from its FIG. 3(*a*) condition to its FIG. 3(*b*) condition. This is mentioned for the purpose of emphasizing that the amount of expansion required of the bellows to move piston 20 from its position in FIG. 3(*a*) to that shown in FIG. 3(*b*) is slight, so that the conditioned air flowing into the room or zone continues to be at approximately half volume.

As is shown in FIG. 3(*b*), piston heads 20*e*$_1$ and 20*e*$_2$ are free and clear of channels 20*b* and 20*c*, respectively, so that both channels are completely open which means that control channels 14*d* and 14*e* of fluidic amplifier apparatus 14 now communicate through tubes 23*a* and 23*d* and through tubes 24*a* and 24*b* to the orifices in output channels 21*b* and 21*c* in fluidic amplifier apparatus 21. At this stage of the operation, and in accordance with scientific principles well known by those skilled in the art, the pulses of conditioned air flowing through and out of output channels 21*b* and 21*c* create correspondingly partial vacuums in the aforementioned tubes, what may be termed "suction pulses," and these suction pulses are respectively applied to control channels 14*e* and 14*d* to cause the stream of conditioned air flowing through fluidic amplifier apparatus 14 to be switched back and forth, in an oscillatory manner, between output channels 14*b* and 14*c* in response thereto. Thus, in the circumstances being described, it may be said that a master-slave situation exists in which the pulsed oscillation of fluidic amplifier apparatus 21 produces a corresponding pulsed oscillation out of fluidic amplifier apparatus 14.

Carrying this explanation one step further, since the pulses out of output channel 21*b* are of relatively long duration compared to those out of output channel 21*c*, then the duration of the pulses out of output channel 14*c* are likewise long compared to those out of output channel 14*b*, with the result that during any oscillatory cycle, bulb 12*c* is exposed to the ambient air rather than to the conditioned air during a major portion of the cycle. Consequently, for the reasons given in connection with the description of the FIG. 1 embodiment, Dan Foss valve 12 will open to permit hot water to flow into hot-water coils 11, thereby warming the conditioned air in such manner as to help bring the room or zone air temperature to the desired temperature and maintain it there, all as was previously explained in connection with the FIG. 1 embodiment.

Having described the two embodiments of the invention illustrated herein, it would be fitting at this point, by way of conclusion, to summarize their basic aspects or characteristics. Briefly stated, in the air-conditioning system of FIG. 1, under the complete control of fluidic amplifier apparatus, the conditioned air flowing to the room or zone to be conditioned is increasingly warmed or heated as the air in the room or zone approaches the desired temperature, the amount the conditioned air is ultimately heated being such as to substantially maintain the room or zone temperature at the desired temperature as determined by the thermostatic setting. In the FIG. 2 embodiment, on the other hand, also under the control of fluidic amplifier apparatus, the volume of conditioned air flowing to the room or zone is first gradually reduced to about half before the FIG. 1 portion of this embodiment commences to warm it.

Although particular arrangements of the invention have been illustrated and described hereinabove, it has been by way of example and is not intended that the invention be limited thereto. Accordingly, the invention should be considered to include any and all modifications, alterations or equivalent arrangements falling within the scope of the annexed claims.

What is claimed is:

1. An air-conditioning system mounted between input and output ducts, the conditioned air entering the system via the input duct and exiting the system for the room or zone to be conditioned via the output duct, said system having hot-water coils mounted therein and a valve for regulating the flow of hot water thereto, said system comprising: first pure fluid amplifier means for varying the volume of the conditioned air exiting the system according to the air-conditioning requirements of the room or zone, the greater the requirement the greater the volume and vice versa; second pure fluid amplifier means operable to variably open the close the valve according to the air-conditioning requirements of the room or zone, the greater the requirement the less the valve opening and vice versa; and third means coupled between said first and second means, said third means including first apparatus coupled to said first means to limit the variations in the volume of conditioned air to between full and half volume, said third means including second apparatus to activate said second means when said first means has reduced the flow of conditioned air to substantially half volume.

2. The air-conditioning system defined in claim 1 wherein said first pure fluid amplifier means includes a system duct partitioned to form first and second chambers that are respectively coupled to the input and output ducts; an inside duct intercoupling said first and second chambers to permit air entering said first chamber to flow into said second chamber; an inflatable device mounted beneath the mouth of said inside duct and operable to control the amount of conditioned air flowing through it to said second chamber, the amount of conditioned air flowing through said first inside duct corresponding to the spacing between the mouth of said inside duct and said inflatable device and, therefore, to the degree to which said device is inflated; said first fluidic amplifier apparatus for inflating and deflating said inflatable device according to the air-conditioning requirements of the room or zone, the greater the requirement the less the inflation and vice versa.

3. The air-conditioning system defined in claim 2 wherein said first fluidic amplifier apparatus has at least an input channel coupled to said first chamber to tap off a portion of the conditioned air flowing therein, a pair of output channels, one of said output channels being coupled to said inflatable device to feed said tapped-off air thereto, and a pair of control channels through which pressures may respectively be exerted against said tapped-off air to switch the flow thereof between said output channels; and a thermovalve mounted in the room or zone and coupled to said pair of control channels to produce said pressures as a function of the room's or zone's air-conditioning requirements.

4. The air-conditioning system defined in claim 2 wherein said first fluidic amplifier apparatus includes a first fluidic oscillator having an input channel coupled to receive a portion of the conditioned air entering the system, and a pair of output channels to which said portion of air flows, one of said output channels being coupled to said inflatable device, said oscillator apparatus including first means to switch the air flowing therein in an oscillatory manner between said pair of output channels to produce pulses of conditioned air that are alternately applied to said pair of output channels, said oscillator apparatus including second means to vary the duration of said pulses with changes in the temperature of the room or zone, the duration of the pulses of air flowing through said one output channel and into said inflatable device increasing and decreasing, respectively, as the need for conditioned air in the room decreases and increases.

5. The air-conditioning system defined in claim 2 wherein said second pure fluid amplifier means includes second fluidic amplifier apparatus having at least an input channel coupled to said first chamber to tap off a portion of the conditioned air flowing therein, a pair of output channels, one of said output channels being coupled to the valve to feed said tapped-off air thereto, and a pair of control channels through which pressures may respectively be exerted against said tapped-off air to switch the flow thereto between said output channels, said pair of control channels being coupled through said third means to said first fluidic amplifier apparatus.

6. The air-conditioning system defined in claim 2 wherein said second pure fluid amplifier means includes a second fluidic oscillator having at least an input channel coupled to said first chamber to tap off a portion of the conditioned air flowing therein, a pair of output channels to which said portion of air flows, one of said output channels being coupled to the valve to feed said tapped-off air thereto, and additional means being operable to switch the air flowing in said oscillator in an oscillatory manner between said pair of output channels to produce pulses of conditioned air at said one output channel.

7. The air-conditioning system defined in claim 2 wherein said first fluidic amplifier apparatus includes a first fluidic oscillator having an input channel coupled to said first chamber to tap off a portion of the conditioned air flowing therein, a pair of output channels, one of said output channels being coupled to said inflatable device to feed said tapped-off air thereto, a pair of control channels through which pressures are exerted against said tapped-off air to switch the flow thereof in an oscillatory manner between said pair of output channels to produce two trains of pulses of conditioned air of variable duration thereat, and a thermovalve mounted in the room or zone and coupled to said pair of control channels to produce said pressures as a function of the room's or zone's air-conditioning requirements; wherein said second pure fluid amplifier means includes a second fluidic oscillator having an input channel coupled to said first chamber to tap off a portion of the conditioned air flowing therein, a pair of output channels, one of said output channels being coupled to the valve to feed said tapped off air thereto, and a pair of control channels through which pressures may be exerted against said tapped-off air to switch the flow thereof in an oscillatory manner between said pair of output channels to produce two trains of pulses of conditioned air of variable duration thereat; and wherein said third means is mounted between the control channels of said second fluidic oscillator and the output channels of said first fluidic oscillator and operable in response to the movement of said inflatable device to intercouple said channels.

8. The air-conditioning system defined in claim 7 wherein said third means is mounted between said inflatable device and the mouth of said inside duct, the first apparatus therein being adapted to prevent said device from inflating further once the volume of air is reduced to approximately one half.

9. The air-conditioning system defined in claim 7 wherein said third means includes a spool valve having first and second channels respectively intercoupling the control channels of said second fluidic oscillator and the output channels of said first fluidic oscillator, a cylinder extending transversely to said first and second channels, and a piston member slidably mounted in said cylinder, said piston member being in a first position when said inflatable device is deflated such that said first channel is closed by said piston member and said second channel is open, said piston member moving to a second position as said inflatable device becomes inflated such that both said first and second channels are open.

* * * * *